US005985406A

United States Patent [19]

Takizawa et al.

[11] Patent Number: 5,985,406

[45] Date of Patent: Nov. 16, 1999

[54] SEPARABLE FASTENER

[75] Inventors: Toshiaki Takizawa, Kurobe; Tsuyoshi Minato, Toyama, both of Japan

[73] Assignee: YKK Corporation, Tokyo, Japan

[21] Appl. No.: 08/865,974

[22] Filed: May 30, 1997

[30] Foreign Application Priority Data

May 31, 1996 [JP] Japan ..... 8-159136

[51] Int. Cl.[6] ..... A44B 18/00

[52] U.S. Cl. ..... 428/99; 428/100; 428/350; 24/306; 24/444; 24/451

[58] Field of Search ..... 428/99, 100, 350; 24/442, 444, 306, 451

[56] References Cited

U.S. PATENT DOCUMENTS 3,848,556 11/1974 Terada et al. ..... 112/265
3,863,304 2/1975 Brumlik ..... 24/204
4,307,496 12/1981 Nakagaki et al. ..... 28/168
4,717,611 1/1988 Petrella ..... 428/100
5,360,270 11/1994 Appeldorn et al. ..... 383/5

FOREIGN PATENT DOCUMENTS 0 418 951 A2 3/1991 European Pat. Off. .
0 430 641 A2 6/1991 European Pat. Off. .

*Primary Examiner*—Alexander Thomas
*Attorney, Agent, or Firm*—Hill & Simpson

[57] ABSTRACT

Disclosed is a separable fastener which can be appropriately used as a fastening means for disposable products. In a separable fastener composed of a base part and a multiplicity of engaging elements raised from the obverse side of the base part, a water-soluble resinous material is present at least on the reverse side of the base part. Advantageously, a resin which manifests adhesiveness on absorbing water is used for the water-soluble resinous material. In another mode of the separable fastener, the base part and the engaging elements are made of a water-soluble resinous material and/or a biodegradable resin.

9 Claims, 4 Drawing Sheets

SEPARABLE FASTENER

BACKGROUND OF THE INVENTION

1. Field of the Invention

This invention relates to a separable fastener of the hook-and-loop type, male-and-female type, hook-to-hook type or other type (hereinafter referred to generally as "separable fastener") and more particularly to a separable fastener which can be appropriately used as a fastening means for disposable products.

2. Description of the Prior Art

The conventional separable fastener generally comprises a substrate having the reverse side thereof coated with a layer of an organic solvent type adhesive agent, the surface of the adhesive layer being coated with a release paper. The separable fastener thus constructed needs to be stripped of the release paper before it is applied to a given object. Prior to use, therefore, it must spend time and labor for the separation of the release paper and suffer the separated release paper to be discarded as waste and, as a result, take part in the recent problem of disposal of plastics waste.

Disposable products such as diapers which are made of water-soluble resins have been developed recently. Such disposable products as are made of water-soluble resin are dissolved and disintegrated when they are left immersed in water. They are, therefore, discarded safely in flush toilet and enabled to contribute to the solution of the problem of waste disposal. The base cloth of a diaper, for example, is tied and untied generally by means of such fastening means as a separable fastener. Since these fastening means are made of a water-insoluble resin, the diaper to which the fastening means is left attached cannot be discarded in the flush toilet. The fastening means such as a separable fastener is attached to the base cloth with an organic solvent type adhesive agent. Even after the fastening means has been removed from the base cloth, therefore, the component of the adhesive agent is suffered to remain on the base fabric and mingle in the waste water in the flush toilet and consequently form one cause for the problem of waste water disposal and the pollution of river water.

In recent years, the problem of disposal of plastics waste has come to attract attention from the viewpoint of conservation of the earth's environment and the demand for the development of a technology for waste disposal has been gaining in enthusiasm. As one of the targets of the development, the biodegradable plastics to be incorporated in the circulation of matter in the natural world have been arresting attention.

The biodegradable resinous materials which are disintegrated on exposure to the microbial action in soil or in water are known in various kinds such as (a) the microbial fermentative production type, (b) starch alloy type, (c) chemical synthesis type, and (d) polylactic acid type. The development of these biodegradable resinous materials for use in such containers as bottles, cups, and trays besides wrapping films and bags is now under way.

No case of applying a biodegradable resin or a water-soluble resin to the separable fastener which is the object of the present invention, however, has been known to the art.

SUMMARY OF THE INVENTION

The present invention has originated in the recognition of the problems of the prior art mentioned above and has for one of the basic objects thereof the provision of a separable fastener which allows easy attachment to a given surface without requiring use of either a conventional release paper fated to turn into a waste or an organic solvent type adhesive agent detrimental to the environment.

A further object of the present invention is to provide a separable fastener which, when attached to such a disposable product as a diaper and subsequently removed therefrom, can be discarded without giving any consideration to the presence of an adhesive agent which is reckoned as one cause for environmental pollution.

Another object of the present invention is to provide a separable fastener which can be properly used on a disposable product made of such a material as water-soluble resin or biodegradable resin and can be discarded as still retained on the disposable product without posing any problem of waste disposal.

To accomplish the objects mentioned above, the basic mode of the present invention provides a separable fastener composed of a base part and a multiplicity of engaging elements raised from the obverse side of the base part and characterized by the presence of a water-soluble resinous material at least on the reverse side of the base part. Advantageously, a resin which manifests adhesiveness on absorbing water is used for the water-soluble resinous material.

This water-soluble resinous material may be partially present on the reverse side of the base part, for example, in the form of scattered dots or in the form of a film as an adhesive layer.

Another mode of the present invention provides a separable fastener which, besides fulfilling the modes mentioned above, has the base part and the engaging elements made of a water-soluble resinous material and/or a biodegradable resin.

BRIEF DESCRIPTION OF THE DRAWINGS

The other objects, features, and advantages of the present invention will become apparent from the following description taken together with the accompanying drawings, in which.

DETAILED DESCRIPTION OF THE INVENTION

Figure 1:
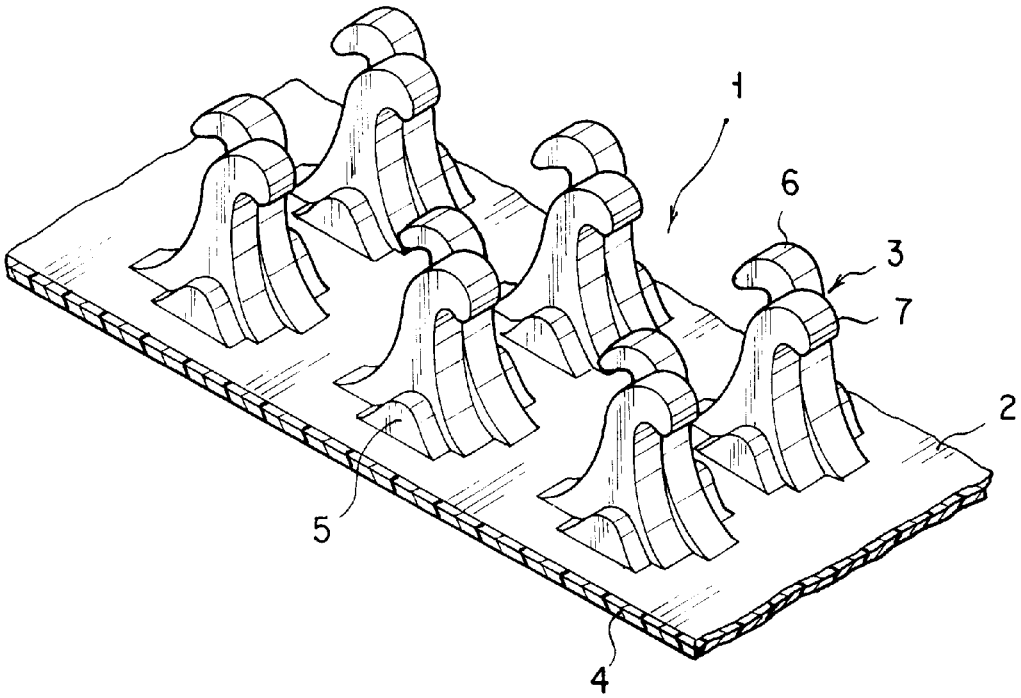
FIG. 1 is a partial perspective view of a male fastener member of a separable fastener as the first embodiment of the present invention.

In the basic mode of the separable fastener according to the present invention, the water-soluble resinous material exists partially or wholly at least on the reverse side of the base part. This water-soluble resinous material is solid in the ordinary state of storage and, therefore, avoids adhering to other object and enables separable fasteners to be piled up and transported. When the surface layer is wetted by being coated or sprayed with water or an aqueous alcohol solution, it softens or melts and begins to manifest adhesiveness.

The separable fastener of the present invention, therefore, is only required to have the water-soluble resinous material on the reverse side of the base part thereof coated or sprayed with a suitable solvent such as water or an aqueous alcohol solution to be conveniently applied fast to given surfaces of steel plates, aluminum plates, foamed plastics material, wood, films or plates of PVC (polyvinyl chloride), acrylic plates, cartons, concrete blocks, cloth, leather, foamed polystyrene plates, etc.

Since the separable fastener utilizes the water-soluble resinous material for the purpose of adhesion, it has no use for the conventional release paper destined to turn into a waste and permits ready adhesion without requiring use of an organic solvent type adhesive agent which is detrimental to the environment. When this separable fastener is used on a disposable product such as a diaper and then removed from the disposable product, the disposable product can be discarded without giving consideration to the presence of the adhesive agent which is reckoned as one cause for environmental pollution.

In the basic mode mentioned above, not only the water-soluble resin and the biodegradable resin which will be described specifically herein below but also various known materials can be used as the material for the base part and the engaging elements of the separable fastener.

In another mode of the separable fastener of the present invention, the base part and the multiplicity of engaging elements raised from the obverse side of the base part are formed of a water-soluble resinous material and/or a biodegradable resin as mentioned above. Even when the disposable products which use the separable fastener of the present invention in their joined parts, for example, diapers, tying bands, covers for seedlings, and covers for nursing mushrooms which are made of the water-soluble resin or the biodegradable resin are discarded after use, they have no possibility of destroying the earth's environment or causing nuisance of waste because they are completely dissolved by the water of the flush toilet or rainwater or they are disintegrated by the action of microorganisms in soil or in water. Further, since the products made of biodegradable resins are reduced in the form of compost to the earth, they have no possibility of turning into scattered debris like those of ordinary plastic products and doing harm to wild animals. The fact that these products lose volume in consequence of the degradation results in elongating the life of a landfill or stabilizing the condition of the landfill. Further, when these products are disposed of by incineration, since the water-soluble resin or the biodegradable resin emits a small amount of heat during the incineration, the possibility of the combustion thereof doing harm to the incinerator is reduced.

As the water-soluble resinous material mentioned above, any resin may be used effectively so long as it possesses a hydrophilic group such as hydroxyl group, carboxylic group, or sulfonic acid group, exhibits solubility in water, manifests moldability, and possesses proper flexibility and hardness. As concrete examples of the material, polyvinyl alcohol, modified polyvinyl alcohol, polyacrylic acid, polyethylene oxide, CMC (carboxymethylcellulose), and gum may be cited. Among other materials enumerated above, the modified polyvinyl alcohol (such as, for example, the graft of a polyoxyalkylene to a vinyl alcohol-allyl alcohol copolymer produced by Nippon Synthetic Chemical Industry Co., Ltd. and marketed under trademark designation of "Ecomaty AX") can be used particularly advantageously.

To be used as the material for the base part and the engaging elements of the separable fastener, the biodegradable resin is required to manifest moldability and proper flexibility and hardness and possess an ability to yield to degradation by the action of microorganisms. As concrete examples of the resin, microbial fermentative production type resins such as a copolymer of hydroxybutyric acid with hydroxyvaleric acid (produced by Zeneka K.K. and marketed under trademark designation of "Biopol"), natural macromolecular (starch) type resins such as a blend of starch with modified polyvinyl alcohol (produced by Nippon Synthetic Chemical Industry Co., Ltd. and marketed under trademark designation of "Mater-Bi"), and a blend of starch with a biodegradable synthetic polymer (produced by Werner Lambert Corp. of U.S. and marketed under trademark designation of "Novon") and chemical synthetic resins, such as aliphatic polyester (produced by Showa Highpolymer Co., Ltd. and marketed under trademark designation of "Bionolle") and polycaprolactone (produced by Daicel Chemical Industry K.K. and marketed under trademark designation of "Praccel"), and polylactic acid may be cited.

The production of the separable fastener of the present invention can be effected by any of the various methods heretofore known to the art, excepting the materials to be used therein are such resins as mentioned above. The separable fastener is not particularly limited in shape. The male fastener member of the separable fastener, for example, may be produced by integrally molding the base part with variously shaped engaging elements, such as engaging elements shaped like hooks, engaging elements containing hemispherical head parts, and engaging elements containing conical head parts, which are raised from the base part. It may be otherwise produced by forming a woven or knitted base fabric so as to be provided with loops raised from the base fabric and cutting the loops thereby converting them into hooks. The structure of the male fastener member is not limited to a specific one. As concerns the female fastener member of the separable fastener, any type of the female fastener such as a pile woven or knitted fabric containing loops, a woven or knitted fabric raised so as to form a multiplicity of loops on the surface thereof, or non-woven fabric may be used so long as it is invariably capable of allowing the engaging elements of the male fastener member to be engaged therewith. Further, by shaping the head parts of the engaging elements so as to project hook parts in opposite sides or in numerous directions, the separable fastener enables the hook parts to engage mutually and functions concurrently as a male member and a female member. For the purpose of augmenting the flexibility or the bending strength of the resinous base part, the base part may allow rubber threads, reinforcing fibers, cloth, non-woven fabric, or the like to be embedded therein, depending on the physical properties aimed at.

The separable fastener of the present invention can be applied to various uses which make the most of the characteristic properties of the material used therefor, besides the uses mentioned above. It can be advantageously used as applied fast to a curved surface, for example, by utilizing the flexibility thereof. Since the water-soluble resinous material has compatibility such as with urethane foam, the separable fastener of the present invention can be advantageously used as an engaging means between a urethane foam cushioning material on an automobile seat and a sheet material (fabric). To be specific, the sheet material can be fastened with ample binding force to the urethane foam by applying water to the water-soluble resinous material on the reverse side of the base part of the separable fastener thereby melting the surface of the resinous material, then applying the molten surface fast to the urethane foam, and establishing engagement between the engaging elements on the surface and the sheet material. Since this bondage is in the form of surface engagement, the joined parts will not swell. Otherwise, by forming the water-soluble resinous material on the reverse side of the base part in the shape of a multiplicity of hooks and burying it in the urethane foam, the separable fastener is enabled to manifest an increased binding force owing to the anchoring effect of the hooks. As another example of the use for the separable fastener of the present invention, a wallpaper produced by printing a sheet of non-woven fabric may be applied to a wall through the medium of the separable fastener of the present invention fixed to the wall by utilizing the water-soluble resinous material on the reverse side of the base part as an adhesive agent, namely by making use of the engaging force between the engaging elements on the obverse side of the separable fastener and the non-woven fabric.

Now, the various modes of the separable fastener of the present invention and the method for production thereof will be described specifically below with reference to the embodiments illustrated in the accompanying drawings.

Figure 2:
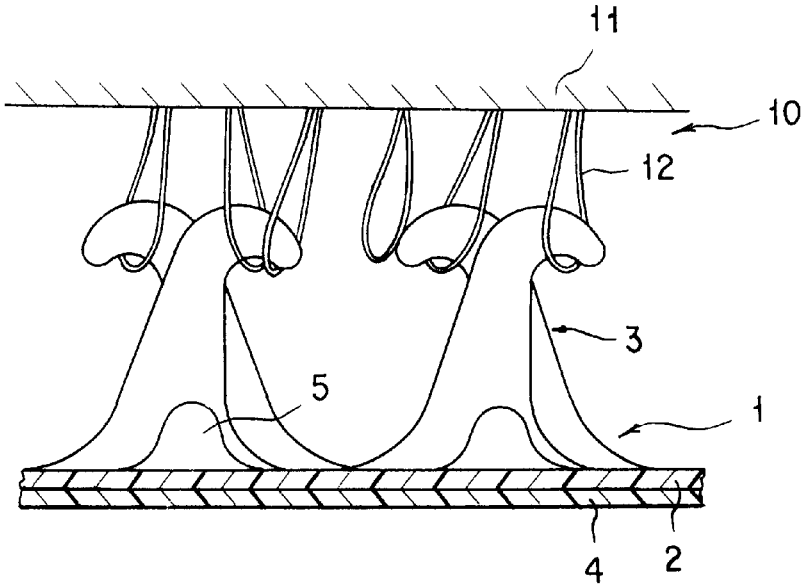
FIG. 2 is a fragmentary cross section illustrating the state of engagement between the male fastener member shown in FIG. 1 and a female fastener member.

FIG. 1 and FIG. 2 illustrate the separable fastener as the first embodiment of the present invention; FIG. 1 representing a perspective view of a male fastener member 1 and FIG. 2 representing the state of engagement between the male fastener member 1 and a female fastener member 10.

The male fastener member 1 is manufactured by integrally molding a base part 2 and a multiplicity of hooked engaging elements 3 raised from the base part both with a resinous material. The engaging elements 3 are each formed of a pair of adjacent hook pieces 6 and 7 which have their hooked leading ends pointed in the mutually opposite directions and these engaging elements 3 are disposed as opposed to each other across reinforcing ribs 5 which arranged at prescribed intervals in the longitudinal direction and the lateral direction of the base part 2. A water-soluble resin layer 4 is superposed on the reverse side of the base part 2. The base part 2 and the engaging elements 3 mentioned above are formed of varying resin heretofore in popular use, a water-soluble resin or a biodegradable resin. Though the water-soluble resin layer 4 in this embodiment is depicted as formed in the shape of a layer throughout the entire surface of the base part 2, it may be partially present in the shape of a film or in the shape of projections, needles, hooks, or the like to suit the purpose of use.

This male fastener member 1 and the female fastener member 10 which have a multiplicity of looped engaging elements 12 projected from the obverse side of a base part 11 manufactured by weaving or knitting fibers are brought into fast engagement by the fact that the hooked engaging element 3 are caught on the looped engaging elements 12 as shown in FIG. 2.

Figure 3:
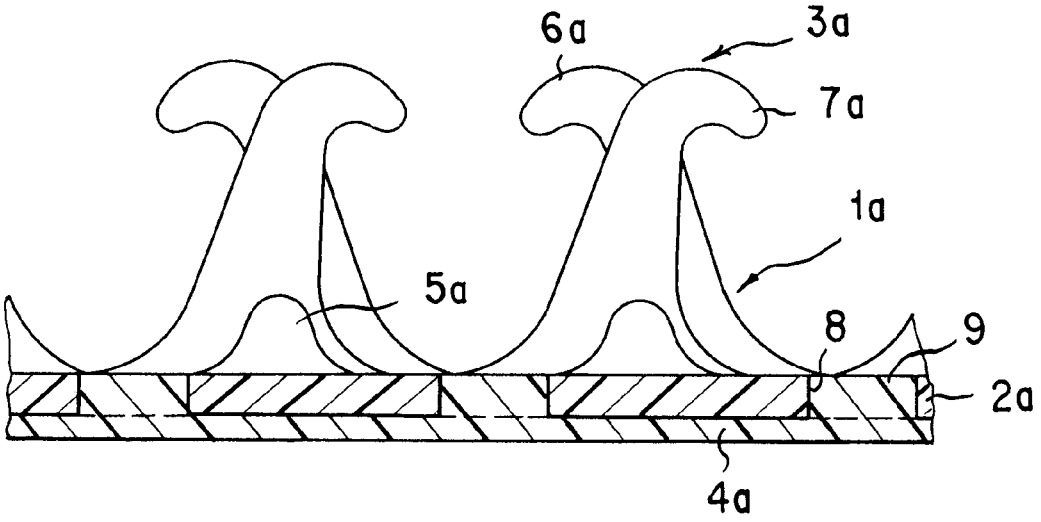
FIG. 3 is a fragmentary cross section of a male fastener member as the second embodiment of the present invention.

FIG. 3 represents a male fastener member of the separable fastener as the second embodiment of the present invention. This male fastener member is one modification of the male fastener member which is shown in FIG. 1.

In this male fastener member 1*a* of the present embodiment, a base part 2*a* and a water-soluble resin layer 4*a* are more firmly integrated by the insertion of projected parts 9 of the water-soluble resin layer 4*a* into the holes 8 of the base part 2*a*. Engaging elements 3*a* each formed of a pair of hook pieces 6*a* and 7*a* and reinforcing ribs 5*a* have structures resembling those in the first embodiment mentioned above.

The male fastener members 1 and 1*a* respective of the first and the second embodiment mentioned above are enabled to adhere fast to the surfaces of target objects by wetting the water-soluble resin layers 4 and 4*a* with a solvent such as water or an aqueous alcohol solution and consequently causing their surfaces to assume a softened or molten state with absorbed water.

Figure 4:
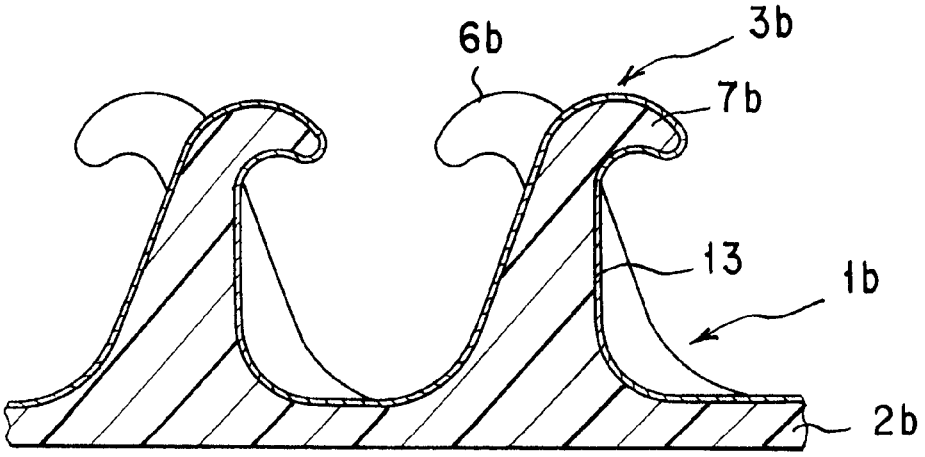
FIG. 4 is a fragmentary cross section of a male fastener member as the third embodiment of the present invention.

FIG. 4 represents a male fastener member of the separable fastener as the third embodiment of the present invention.

In this embodiment, a base part 2*b* and engaging elements 3*b* each formed of a pair of hook pieces 6*b* and 7*b* both of a male fastener member lb are integrally molded with a water-soluble resin. The engaging elements 3*b* are vested with proofness against water by having their surfaces coated with a waterproof resin coating layer 13.

In the present embodiment, the fastener member can be attached fast to the surface of other object by applying or spraying water or an aqueous alcohol solution to the reverse side of the base part 2*b* which is made of a water-soluble resin.

Figure 5:
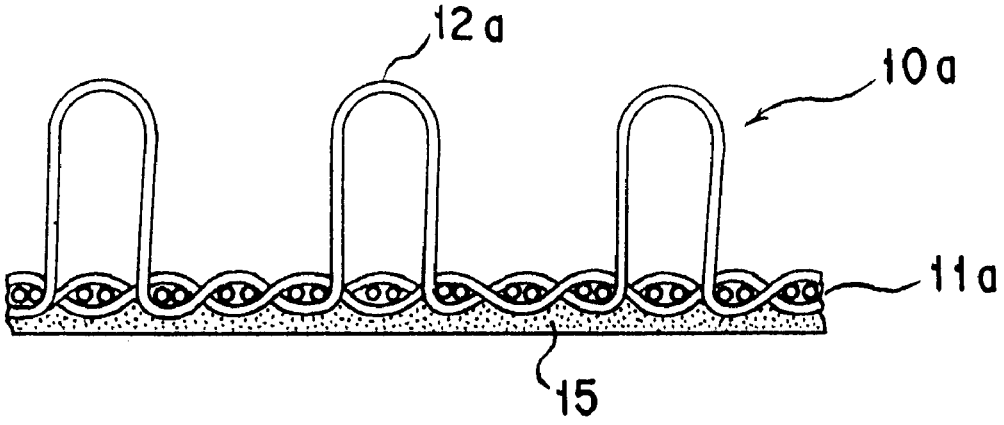
FIG. 5 is a fragmentary cross section of a female fastener member as the fourth embodiment of the present invention.
Figure 6:
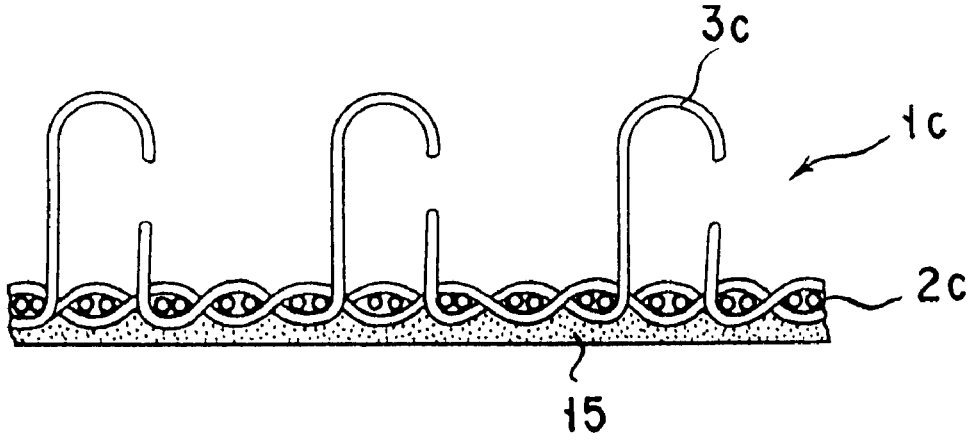
FIG. 6 is a fragmentary cross section of a male fastener member as the fourth embodiment of the present invention.

FIG. 5 and FIG. 6 illustrate the fourth embodiment of the separable fastener of the present invention, i.e. a separable fastener which is manufactured by preparing monofilaments or multifilements of a water-soluble resin and interweaving them.

In a female fastener member 10*a* shown in FIG. 5, pile yarns formed of water-soluble resin filaments are interwoven in a pile pattern into a base part (base fabric) 11*a* produced by plain weaving water-soluble resin filaments so as to give rise to looped female engaging elements 12*a* which protrude from the obverse side of the base part 11*a*. A male fastener member 1*c* shown in FIG. 6 is identical in structure with the female fastener member 10*a* mentioned above excepting that the loops are partially cut to form hooked engaging elements 3*c*.

A back coating layer 15 formed of a water-soluble resin and adapted to prevent the woven yarns from being frayed is applied to the reverse side of the female fastener member 10*a* and the male fastener member 1*c*. Since this back coating layer 15 is manufactured with a water-soluble resin, it is allowed, on being moistened with water, to function as an adhesive layer.

When the separable fasteners 1*c* and 10*a* constructed as described above are discarded, they have no possibility of posing the problem of pollution with waste because all parts are made of the water-soluble resin and are completely dissolved as by the water of the flush toilet or rainwater.

The same remarks hold good for the third embodiment described above. In the case of the third embodiment, though the waterproof resin coating film 13 survives the action of the water of the flush toilet or the rainwater, it is in such a very small amount that it will not induce pollution of the environment. The use of the biodegradable resin as the material for the resin coating film 13 proves advantageous from the viewpoint of the conservation of the environment because it is disintegrated by microorganisms in soil or in water.

Now, a preferred method for the production of the male fastener member 1 of the present invention will be described below with reference to FIG. 7.

Figure 7:
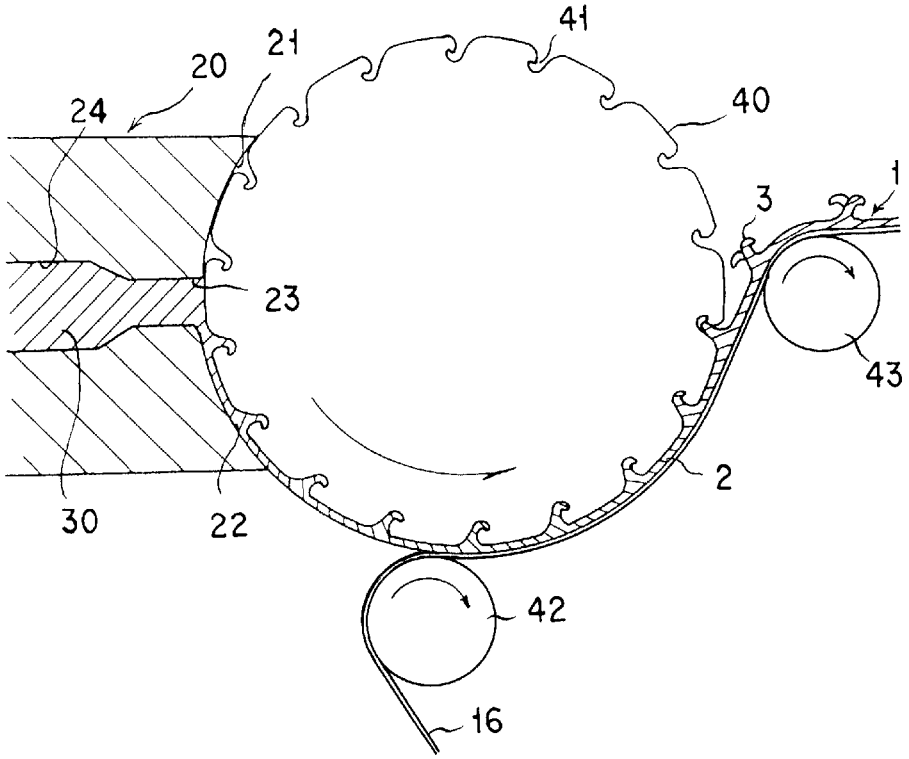
FIG. 7 is a schematic cross section of the essential part of a molding apparatus for the male fastener member shown in FIG. 1.

FIG. 7 illustrates the essential part of an apparatus for continuous production of a male fastener member. In the diagram, the reference numeral 20 denotes an injection nozzle. The upper half part of the leading end face of the nozzle 20 is formed in the shape of an arced face 21 identical in radius of curvature with a die wheel 40 which will be described specifically herein below and the lower half part of the leading end face in the shape of an arced face 22 having a prescribed gap from the curved face of the die wheel 40. This injection nozzle 20 is formed of a T die and is adapted to inject molten resin 30 in the form of sheet through an injection orifice 23. In the present embodiment, the injection nozzle 20 is provided along the center thereof with one molten resin flow path 24.

The die wheel 40 has formed on the peripheral face thereof a multiplicity of cavities 41 so shaped as to conform to the engaging elements 3 and the reinforcing ribs 5 of the male fastener member 1. The die wheel 40 is so disposed that the axis thereof may lie parallelly to the injection orifice 23, leaving a prescribed gap between the die wheel 40 and the upper arced face 21 and the lower arced face 22 of the injection nozzle 20.

The structure of the die wheel 40 will be briefly described below. It is shaped like a hollow drum provided on the inside thereof with a water-cooling jacket (not shown). The intermediate part of the die wheel 40 along the axis is formed of a multiplicity of annular plate members which are fixed in a superposed state. On the circumferential faces of the prescribed ones of the annular plate members, a multiplicity of notches are formed in shapes conforming with those of the hooked engaging elements 3 or the reinforcing ribs of the male fastener member 1 mentioned above. Annular plate members provided with notches conforming in shape with the reinforcing ribs 5 and annular plate members provided with notches conforming in shape with the hooked engaging elements 3 which are severally prepared in prescribed numbers in a prescribed sequence are so arranged as to match the notches and are nipped between two annular plate members which are devoid of notches to complete a unit set. By superposing a plurality of such unit sets, the multiplicity of cavities 41 conforming in shape with the engaging elements 3 and the reinforcing ribs of the male fastener member 1 shown in FIG. 1 are formed on the integral peripheral face of the joined unit sets.

The molten resin 30 injected from the injection nozzle 20 is forced into the gap formed between the end face of the injection nozzle 20 and the die wheel 40 rotating in the direction of an arrow and part of the spouting molten resin is caused to fill the cavities 41 sequentially and consequently form the hooked engaging elements 3 and the reinforcing ribs 5 and, at the same time, form continuously the platelike base part 2 having prescribed thickness and width.

In the lower part of the molding apparatus, a press roll 42 is disposed in proximity to the injection nozzle 20. By this press roll 42, a water-soluble resin film 16 is attached fast to the base part 2 of the male fastener member 1 which is freshly formed on the die wheel 40 and still kept in a partly molten state or a softened state. The male fastener member 1 on which the water-soluble resin film 16 has been superposed fast as described above is gradually cooled and solidified while being revolved in conjunction with the die wheel 40, with the result that male fastener member 1 integrated with the water-soluble resin film 16 is continuously molded.

Subsequently, when the male fastener member 1 which has been molded and solidified as described above is reversed at the position of a guide roll 43 and drawn in the same direction as the direction of injection with proper tensile strength, the engaging elements 3 in the cavities 41 mentioned above are smoothly pulled out while being elastically deformed. Thus, the male fastener member 1 in an elongate shape as shown in FIG. 1 is continuously manufactured with high productivity.

Then, in the production of the male fastener member 1*a* shown in FIG. 3, a water-soluble resin film having projections of a prescribed shape formed thereon at a prescribed interval is used as the water-soluble resin film 16 mentioned above and it is pressed by means of the press roll 42 against the fastener member 1 which has been freshly formed on the die wheel 40 and is still in a partly molten state or a softened state so that the projections mentioned above may be thrust into the fastener member 1.

Incidentally, the water-soluble resin film 16 is attached fast to the reverse side of the fastener member 1 because it is pressed against the fastener member 1 which is still in the partly molten state or softened state as described above. Though the press roll 42 is depicted as separated from the injection nozzle 20 in the drawing, it is preferred to be disposed as closely to the injection nozzle as permissible. The press roll 42, when necessary, may be disposed at a position to be produced by partly cutting away the lower part of the leading end of the injection nozzle 20, for example. Otherwise, a guide path for the water-soluble resin film 16 may be formed inside the injection nozzle 20 below the molten resin flow path 24 and the press roll 42 may be disposed at a position produced by partly cutting away the lower part of the injection nozzle on the outlet side of the guide path. Optionally, two molten resins differing in kind may be simultaneously injection molded as illustrated in FIG. 8.

Figure 8:
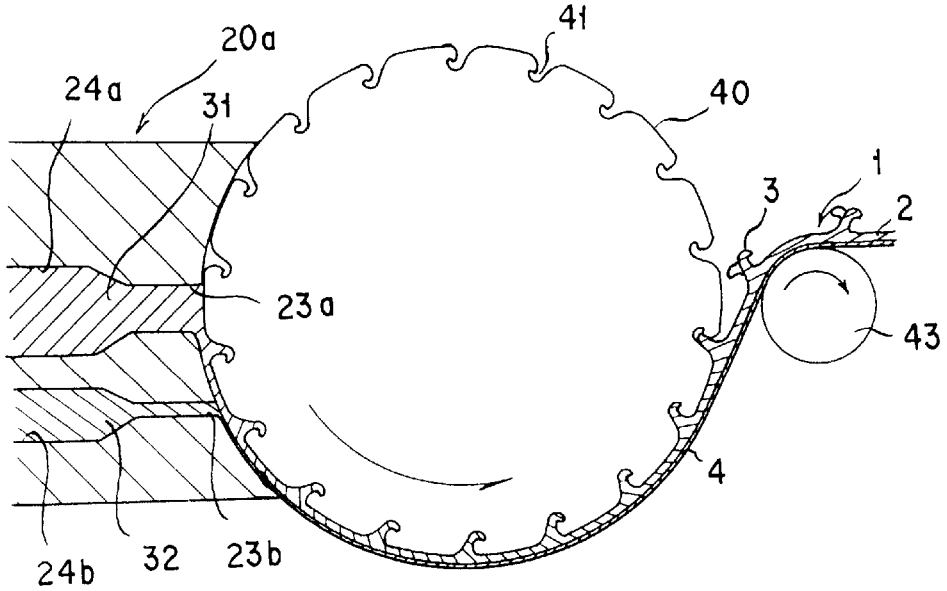
FIG. 8 is a schematic cross section of the essential part of another molding apparatus for another male fastener member of the present invention.

A molding apparatus illustrating in FIG. 8 differs from the apparatus shown in FIG. 7 in respect that an injection nozzle 20*a* is provided with two injection orifices 23*a* and 23*b*, one upper and the other lower, and molten resin paths 24*a* and 24*b* communicating respectively thereto and a press roll is omitted. These molding apparatuses are otherwise identical in structure.

In the present molding apparatus, the base part 2 and the engaging elements 3 of the male fastener member 1 are integrally formed with a molten resin 31 which is injected through the injection orifice 23*a* and, at the same time, the water-soluble resin layer 4 is integrally formed on the reverse side of the base part with a water-soluble resin 32 injected in a molten state through the injection orifice 23*b*. Various resins are usable for the molten resin 31. A separable fastener formed in two colors may be manufactured by causing the molten resin 31 and the water-soluble resin 32 in the molten state to incorporate therein pigments differing in color.

When the base part and the engaging elements of the separable fastener are to be manufactured with a water-soluble resin, it suffices simply to injection mold a water-soluble resin. This manufacture has no use for either the laminating method using a water-soluble resin film or the co-injection method using a water-soluble resin and other resin.

Then, separable fasteners manufactured from water-soluble resins were tested for peel strength and shear strength. The results of the test are shown in the Table herein below.

By the use of an apparatus constructed as illustrated in FIG. 7, a male fastener member, 0.15 mm in base part thickness and 25 mm in width, was manufactured from a water-soluble resin of a modified polyvinyl alcohol (produced by Nippon Synthetic Chemical Industry Co., Ltd. and marketed under trademark designation of "Ecomaty-AX-300") under the conditions of an injecting device temperature of 225° C. and a molding device temperature of 230° C. For comparison, male fastener members of the same shape and size as mentioned above were made from low-density polyethylene (LDPE; produced by Mitsubishi Chemical Co., Ltd. and marketed under product code of "LF685"), high-density polyethylene (HDPE; produced by Mitsubishi Chemical Co., Ltd. and marketed under product code of "HY540"), and polypropylene (PP; produced by Mitsubishi Chemical Co., Ltd. and marketed under product code of "EA7A"). The male fastener members so produced were invariably products independently formed from the various resins mentioned above.

The male fastener members so produced were stored in nylon bags for three weeks after their molding, then joined each to a female fastener member (25 mm in width) manufactured by weaving nylon yarns, and tested for peel strength (180 degree separation) and shear strength. The magnitudes of peel strength and shear strength shown in the table were averages each obtained of three samples. Since the day chosen for the test had a rainy weather, the samples were stored for four hours in a thermo-hygrostat kept at 23° C. and 63% RH before they were put to test.

TABLE

| Material used for male fastener member | Peel strength (g) | Shear strength (kg) |
|---|---|---|
| Ecomaty AX-300 | 45.5 | 23.5 |
| Low-density polyethylene | 16.5 | 5.6[1)] |
| High-density polyethylene | 23.5 | 13.5[2)] |
| Polypropylene | 37.5 | 16.2[3)] |

Remarks
[1)]One sample fractured.
[2)]One sample fractured.
[3)]One sample fractured and one sample stretched.

It is clear from the Table that the separable fasteners of the present invention possessed fully satisfactory fastening strength.

While certain specific embodiments and working examples have been disclosed herein, the invention may be embodied in other specific forms without departing from the spirit or essential characteristics thereof. The described embodiments and examples are therefore to be considered in all respects as illustrative and not restrictive, the scope of the invention being indicated by the appended claims rather than by the foregoing description and all changes which come within the meaning and range of equivalency of the claims are, therefore, intended to be embraced therein.

What is claimed is:

1. A separable fastener comprising a base part having first and second opposed major surfaces, a plurality of engaging elements projecting from the first major surface and a water-soluble resinous material in a solid state disposed on the second major surface.

2. The separable fastener according to claim 1, wherein said water-soluble resinous material is a resin which manifests adhesiveness on absorbing water.

3. The separable fastener according to claim 1, wherein said water-soluble resinous material is present in the form of a film functioning as an adhesive layer.

4. The separable fastener according to claim 3, wherein said base part has a plurality of holes and said film of the water-soluble resinous material has a plurality of projected parts fitted in said holes.

5. The separable fastener according to claim 1, wherein said base part and said engaging elements are made of a water-soluble resinous material.

6. The separable fastener according to claim 1, wherein said base part and said engaging elements are made of a biodegradable resin.

7. The separable fastener according to claim 1, wherein said engaging elements have surfaces coated with a waterproof resin coating layer.

8. The separable fastener according to claim 1, wherein said base part is a woven or knitted fabric having a back coating layer of said water-soluble resinous material.

9. The separable fastener according to claim 1, wherein said water-soluble resinous material is a modified polyvinyl alcohol.

* * * * *